US005864976A

United States Patent [19]

Yang

[11] Patent Number: 5,864,976

[45] Date of Patent: Feb. 2, 1999

[54] DRIVING MECHANISM OF MUSIC SNOW DROP BALL

[75] Inventor: Shin-Ya Yang, Taipei Hsien, Taiwan

[73] Assignee: Ya Yung Enterprise Co., Ltd., Taipei Hsien, Taiwan

[21] Appl. No.: 908,475

[22] Filed: Aug. 6, 1997

[51] Int. Cl.[6] ..... G09F 19/00

[52] U.S. Cl. ..... 40/410; 40/414; 40/423; 417/424.2

[58] Field of Search ..... 40/406, 409, 410, 40/411, 414, 423; 417/423.1, 424.2

[56] References Cited

U.S. PATENT DOCUMENTS

| | | | |
|---|---|---|---|
| 3,316,847 | 5/1967 | Mandy et al. | 417/423.11 |
| 4,961,276 | 10/1990 | Lin | 40/410 |
| 5,088,218 | 2/1992 | Liu | 40/411 |
| 5,090,144 | 2/1992 | Liu | 40/410 |
| 5,131,175 | 7/1992 | Liu | 40/406 X |
| 5,146,702 | 9/1992 | Belokin, Jr. | 40/414 X |
| 5,339,923 | 8/1994 | Chen | 40/411 X |
| 5,675,921 | 10/1997 | Lin | 40/409 |
| 5,714,814 | 2/1998 | Marioni | 417/423.11 X |

*Primary Examiner*—Joanne Silbermann
*Assistant Examiner*—Andrea Chop
*Attorney, Agent, or Firm*—Pro-Techtor International Services

[57] ABSTRACT

A driving mechanism of music snow drop ball, which provides waterproof effect for avoiding rusting of the mechanism. The driving mechanism includes a water ball and a base disposed under the water ball for containing a seat member, an upper and a lower silicone gaskets, a central shaft rod, a fastening plate and a propeller. Each of the gaskets is formed with an inner and an outer rings defining an annular groove, whereby when assembled with the shaft rod, in the case that the water infiltrates back, the water will accumulate in the annular groove to create a fastening pressure which makes the gasket to bind the shaft rod. Therefore, the water is prevented from infiltrating back into the driving mechanism so as to avoid rusting of the driving mechanism.

1 Claim, 4 Drawing Sheets

DRIVING MECHANISM OF MUSIC SNOW DROP BALL

BACKGROUND OF THE INVENTION

The present invention relates to a driving mechanism of music snow drop ball, which provides waterproof effect for avoiding rusting of the mechanism.

The conventional music snow drop ball includes a driving mechanism for rotating a propeller placed in the water ball. The propeller rotates to drive up the snow drops in the water in accordance with the music emitted from a music bell. A shaft rod is passed through a shaft hole of a rotary tray of a base of the decoration. A clearance exists between the shaft rod and the shaft hole. Therefore, after a period of use, the water in the water ball tends to infiltrate back through the clearance into the driving mechanism. This will lead to rusting of the driving mechanism and affect the operation thereof. Moreover, in the conventional snow drop ball, the power of the driving motor is transmitted through the shaft rod to the base for rotating the propeller. In the case of rusting mechanism, the stirring force of the driving motor is weakened so that the snow drops can be hardly driven up evenly. Furthermore, the rusting mechanism may lead to clogging of the motor.

SUMMARY OF THE INVENTION

It is therefore a primary object of the present invention to provide a driving mechanism of music snow drop ball, which provides waterproof effect for avoiding rusting of the mechanism and enables the propeller of the snow drop ball to rotate normally.

According to the above object, the driving mechanism of music snow drop ball of the present invention includes a seat member, an upper and a lower silicone gaskets, a central shaft rod, a fastening plate and a driving propeller. The silicone gaskets are disposed at upper and lower sections of the shaft rod and formed with annular grooves. When the annular groove is filled with water, the gasket is fastened to bind the shaft rod. Therefore, the water is prevented from infiltrating back so as to avoid rusting of the driving mechanism.

The present invention can be best understood through the following description and accompanying drawings, wherein:

DETAILED DESCRIPTION OF THE PREFERRED EMBODIMENT

Figure 1:
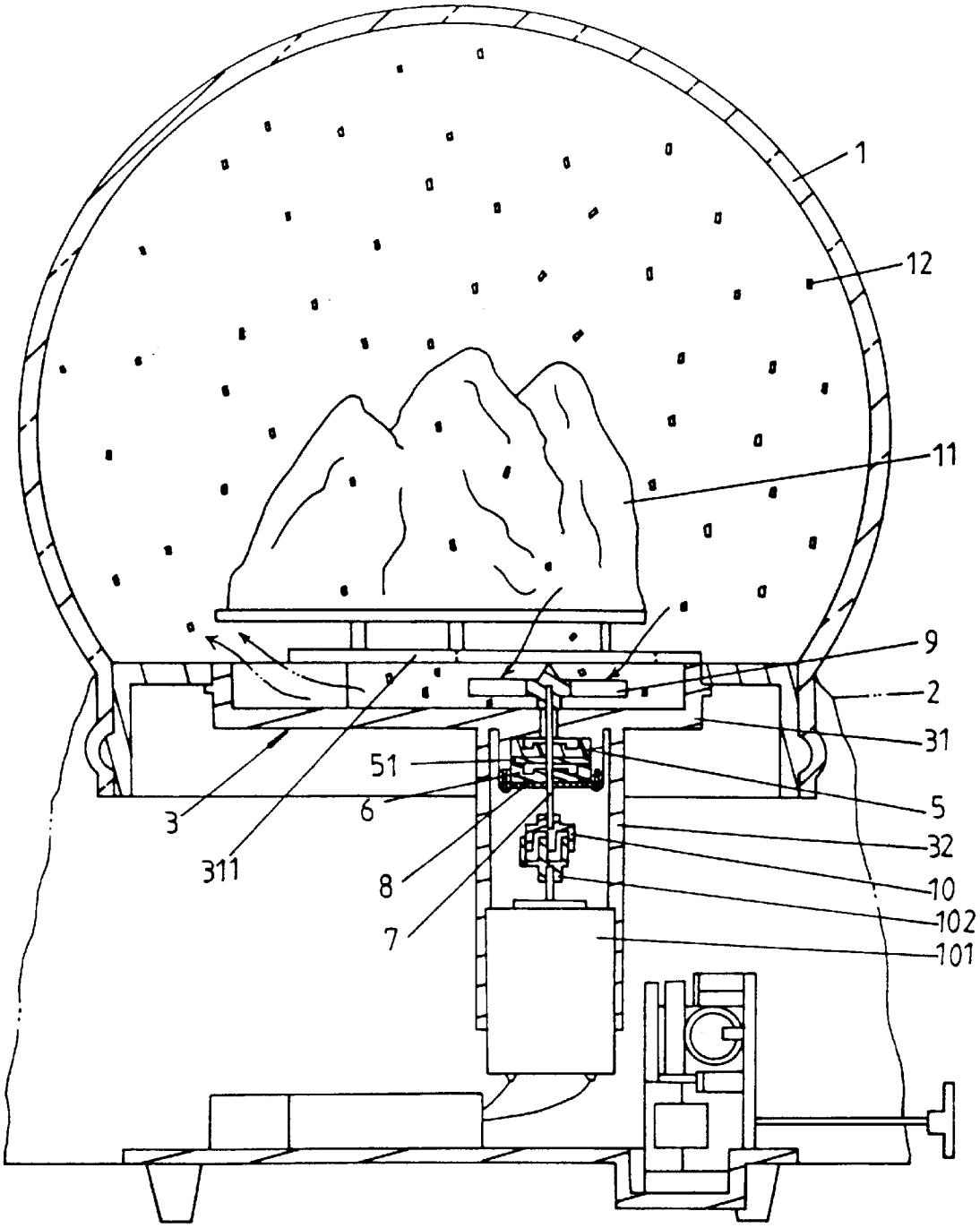
FIG. 1 is a sectional assembled view of the present invention.
Figure 2:
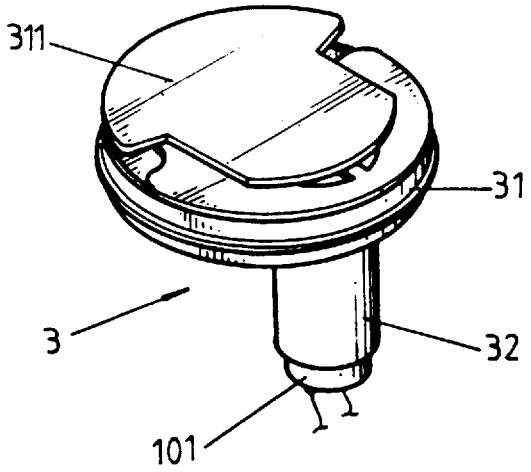
FIG. 2 is a perspective assembled view of the present invention.
Figure 3:
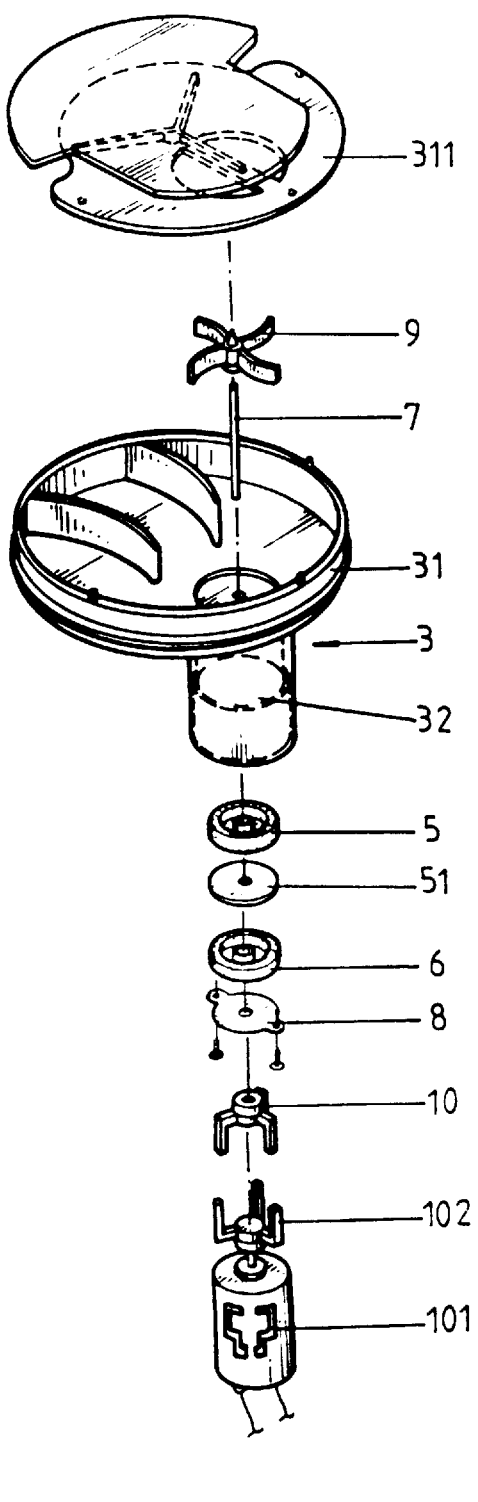
FIG. 3 is a perspective exploded view of the present invention.
Figure 4:
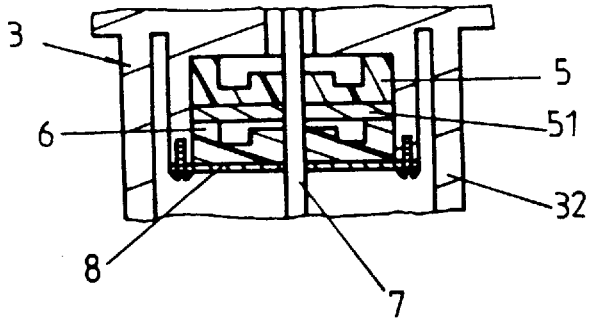
FIG. 4 is a sectional view of the silicone gasket of the present invention, in which the shaft rod is passed through the silicone gasket.

Please refer to FIG. 1. The music snow drop ball 1 of the present invention has internal decoration 11 which can be rotated in accordance with the music. The snow drop ball 1 contains water and snow drops 12 therein. A base 2 is disposed under the water ball 1 for containing a driving motor which provides rotational power for the a propeller 9. The driving mechanism includes a seat member 3, an upper and a lower silicone gaskets 5, 6, a central shaft rod 7, a fastening plate 8 and a propeller 9. The seat member 3 is eccentrically designed, including a disc-like casing 31 and an eccentrical column-like casing 32 integrally connected under the disc-like casing 31. The aforesaid components are placed in the column-like casing 32. The upper and lower silicone gaskets 5, 6 are disposed on upper edge of interior of the casing 32 and a pad member 51 is disposed between the gaskets. The fastening plate 8, upper and lower couplers 10, 102 and driving motor 101 are disposed on lower edges of the gaskets 5, 6. The shaft rod 7 is passed through the above components in sequence. The motor 101 is connected with the lower coupler 102 to transmit power to the upper coupler 10. The motor 101 is assembled with the lower edge of the casing 32. As shown in FIG. 3, each of the gaskets 5, 6 is formed with an inner and an outer rings defining an annular groove. Referring to FIG. 4, when assembled with the shaft rod 7, in the case that the water infiltrates back, the water will accumulate in the annular groove to create a fastening pressure which makes the gasket to bind the shaft rod 7. Therefore, the water is prevented from infiltrating back into the driving mechanism so as to avoid rusting thereof.

The propeller 9 is connected with the upper end of the shaft rod 7 in the disc-like casing 31. Referring to FIG. 3, a disc cover 311 is connected on the casing 31. When the motor 101 drives the lower coupler 102 to rotate and drive the upper coupler 10 via the shaft rod 7, the propeller 9 is driven to evenly stir the water and drive up the snow drops in a flying state.

It is to be understood that the above description and drawings are only used for illustrating one embodiment of the present invention, not intended to limit the scope thereof. Any variation and derivation from the above description and drawings should be included in the scope of the present invention.

What is claimed is:

1. A driving mechanism adapted for a music snow drop ball comprising:

an eccentric seat member, upper and lower silicone gaskets, a central shaft rod, a fastening plate, and a propeller, wherein said seat member includes a disc-like casing with a columnar casing fastened eccentrically to an underside of said disc-like casing, said upper and lower silicone gaskets are disposed on an upper edge of an interior of said columnar casing, and a pad member is disposed between said gaskets, said fastening plate, an upper coupler and a lower coupler, and a driving motor are disposed on lower edges of said gaskets with said shaft rod passing from the propeller, through said gaskets and pad member, through the fastening plate and to the upper coupler, said driving motor is connected to said lower coupler to transmit power to said upper coupler, said driving motor is connected to a lower edge of said columnar casing, each of said gaskets of said driving mechanism is formed with inner and outer rings that define an annular groove, whereby when the gaskets are is assembled with said shaft rod, water can accumulate in said annular groove to create a fastening pressure which makes said gasket bind said shaft rod so that the water is prevented from infiltrating into said lower and upper couplers and said driving motor.

* * * * *